US005528351A

United States Patent [19]

Tsuji

[11] Patent Number: 5,528,351

[45] Date of Patent: Jun. 18, 1996

[54] TONER IMAGE FIXING DEVICE WITH FLAT PAPER-GUIDING MEMBER

[75] Inventor: Masaru Tsuji, Nara, Japan

[73] Assignee: Sharp Kabushiki Kaisha, Osaka, Japan

[21] Appl. No.: 507,697

[22] Filed: Jul. 26, 1995

[30] Foreign Application Priority Data

Oct. 14, 1994 [JP] Japan ..... 6-248982

[51] Int. Cl.[6] ..... G03G 15/20

[52] U.S. Cl. ..... 359/290; 219/216

[58] Field of Search ..... 355/285, 290; 219/216; 118/59; 432/59

[56] References Cited

U.S. PATENT DOCUMENTS

| | | | |
|---|---|---|---|
| 3,452,181 | 6/1969 | Stryjewski | 355/285 |
| 5,124,755 | 6/1992 | Hediger | 355/285 |

FOREIGN PATENT DOCUMENTS

| | | | |
|---|---|---|---|
| 59-68766 | 4/1984 | Japan . | |
| 63-313182 | 12/1988 | Japan . | |
| 4-122969 | 4/1992 | Japan | 355/290 |
| 6-75493 | 3/1994 | Japan | 355/290 |

*Primary Examiner*—Joan H. Pendegrass

*Assistant Examiner*—Quana Grainger

*Attorney, Agent, or Firm*—David G. Conlin; Kevin J. Fournier

[57] ABSTRACT

An elastically-deformable heat-resistant belt is made in the form of a cylinder made of nickel, which accommodates therein a heater lamp and a reflecting plate for concentrically directing radiant heat from the heater lamp to the vicinity of an area wherein the cylinder-like belt comes into contact with a recording paper sheet carrying a toner image. When the recording paper is transferred along a guide plate, the driving roller rotates the heat-resistant belt in contact with the recording paper. At this time, the rotating belt and the guide plate are pressed against each other and, furthermore, the movable guide plate is further pushed toward the belt by rotation of an eccentric cam with an operating lever to vary the pressed condition of the belt to form a flat surface of a paper transferring portion with a variable nip width therebetween. The recording paper sheet is transported being pressed against a flat surface of the heat-resistant belt with a suitable nip width and, thereby, the toner image is fixed onto the recording paper by heat. The fixing condition of the device can be freely changed with a freely settable nip width. The device can effectively fix by heat a toner image developed on recording paper, preventing the latter from being curled.

4 Claims, 4 Drawing Sheets

TONER IMAGE FIXING DEVICE WITH FLAT PAPER-GUIDING MEMBER

BACKGROUND OF THE INVENTION

The present invention relates to a toner image fixing device which has a novel construction for thermally fixing a toner image developed on a sheet-like carrier, e.g., a sheet of recording paper.

In a conventional image recording device, recording medium forms thereon a toner image and transfer it onto a common paper sheet which is subjected to fixing the toner image thereon and then is delivered out of the device. Generally, the toner image is fixed on a paper sheet by fusing.

A fixing device used in a conventional toner image fixing device comprises a rotatably mounted heating roller made of aluminum drum coated with fluorocarbon resin (e.g., PTFE: polytetrafluoroethylene sold under the trade name "Teflon") which is well-releasable from toner and a pressure roller coated with silicone rubber. The heating roller and the pressure roller are disposed as pressed against each other to form therebetween a contact portion (nip) utilizing elastic deformation of the pressure roller. While a sheet carrying a toner image developed with toner thereon passes through the nip, the toner image is heated and fixed by fusing onto the sheet. A heater consisting of, e.g., a halogen lamp is mounted in the heating roller to heat the latter at a specified temperature necessary for fusing toner of the toner image on the sheet. And a separating finger pressed at its head against the external cylindrical surface of the heating roller to separate the sheet from the heating roller.

In the above-mentioned fixing device, the heating roller is made of an aluminum pipe having wall thickness of 1.0 mm to several millimeters and outer diameter of 20 to 60 mm. A toner image developed with toner on the paper sheet is fixed by fusing while the sheet passes through a nip (contacting portion) between the pressure roller and the heating roller heated at a specified temperature by the heater axially mounted therein.

Another example of a toner image fixing device that is different from the above-mentioned device is proposed in Japanese laying-open patent publications Nos. 59-58766 and 63-313182, wherein a belt being an endless film of 10 to 50 microns in thickness made of heat-resistant material (e.g., polyamide) envelops therein a heater supporting member which supports a heater having a resistance on a ceramic substrate in such a manner that the heater may be in contact with an internal surface of the endless belt. A pressure roller disposed in opposite to the heater through the endless belt is pressed against an external surface of the endless belt to form a nip portion through which a paper sheet having a developed toner image passes being subjected to fixture the toner thereon by fusing.

As described previously, the conventional toner image fixing device uses the heating roller having a thickwall of 1.0 to several millimeters in radial direction, which, therefore, shall be previously heated by conduction heat to a specified working temperature of its surface for a warm-up time of several seconds to several minutes. The long warm-up time of the heating roller deteriorates the controllability of the device as well as increases the power consumption. To put a paper sheet into contact with the heating roller, it is needed to use the pressure roller having a metal core coated with silicone rubber, which is expensive in itself and increases a manufacturing cost of the conventional device.

In comparison with the above-mentioned device, the other conventional device uses a thin- film type belt to be heated and, therefore, can save its warm-up time and reduce power consumption required. However, this device also has to use the pressure roller for putting the toner-image carrying paper sheet into close contact with the rotating endless belt, that irrevocably leads to increasing the manufacturing cost of the device. The device must be provided with means for driving the endless belt, (e.g., a driving roller and a driven roller), that may not only complicate the construction of the device but also increase its manufacturing cost.

Each of the conventional art devices uses a fixing member of roll-like form, which can not freely change a nip width and fixing power and, furthermore, may cause curling of recording paper along its body surface.

The necessary fixing power depends upon thickness of recording paper. The thicker recording paper is, the more it absorbs heat, i.e., the less heat is applied for fusing toner on the recording paper if heating temperature (for fixing) is constant. This may result in insufficient fusing the toner onto a thick paper sheet. Furthermore, some paper materials may not easily allow fixation of the toner image developed thereon. In such cases it is effective to selectively change, for instance, increase a nip portion (i.e., contacting surface) of a member for fixing by heat toner image on recording paper, that may increase fixing efficiency and improve the fixing condition of the toner image. For this purpose, pressing force of a pressing member to be applied to a heated member (e.g., a heating roller) is increased to form a wider nipping surface. However, increasing the pressing force to the heating roller may not sufficiently increase the nip width and may result in forcing the paper to be curled.

In the conventional devices, the contact surface of the roller, which comes into contact with a toner-image carrying paper sheet, is heated up to a temperature necessary for fusing toner and has a narrow limited nip width. Therefore, fixing is effected by heating the toner image to the boundary surface of the paper sheet. In this case, an upper part of the toner layer contacted to the heating roller may be heated to abnormally high temperature, reduce cohesive force and transfer to the heating roller surface (i.e., so-called high-temperature offset of toner occurs). On the contrary, when the fixing temperature is adjusted to a relatively low value, toner may keep well-cohesive power but be poor in adhesion to the paper sheet causing so-called low-temperature offset due-to insufficient fusion of the toner on the paper sheet.

In short, the paper sheet is heated at the same temperature during contacting with the heating roller since a whole cylindrical surface of the roller is evenly heated up to a specified temperature. Therefore, the toner may be over-heated causing the high-temperature offset. On the contrary, the low-temperature toner offset may occur due to insufficient fusing if the roller surface temperature is adjusted to a relatively low temperature. For this reason, the conventional devices require high-accuracy temperature control as well as application of offset preventive liquid to the surface of the heating roller to be used.

Even temperature distribution over a whole nip (contact) portion may cause the above-mentioned toner offset. The nip width may be changed by changing pressing force of the pressure roller but this may intensify curling of the paper sheet. Namely, the recording paper in heated state may be easily curled according to a curvature of the heating roller.

The curled paper may jam in the passage when it enters into the image-forming portion again for printing the other side (for two-side printing) or the same side (for double printing). To avoid this, it is necessary to provide a straightener at the downstream side of the fixing device.

In addition, the paper sheet after fixing the toner image thereon may also be in close contact with the heating roller and requires forcibly separation therefrom by a separating finger. To make the paper sheet depart by itself from the heating roller surface without using the separating finger, it is necessary to increase a curvature of the roller to such an extent that the front end of the paper sheet may not follow up the roller. The roller can have a larger curvature by reducing its diameter. In this case, the roller shall have a diameter of not more than 20 mm. This is, of course, accompanied by increasing a degree of curling of the paper sheet. Furthermore, the heating roller of not more than 20 mm in diameter may be hard and expensive to manufacture and may not posses sufficient durability.

As mentioned above, arrangement of a roller-like-formed member (i.e., a heating roller) in a heating portion may inevitably cause curling of recording paper. Namely, the heating roller usually has a constant nip and can not change fixing power by changing its nip width. Pressing force of the heating roller may be increased but can not attain a sufficient change of its nip width resulting in considerable curling of recording paper. Natural separation of recording paper from the heating roller may be realized by using a heating roller having an increased curvature and a reduced diameter. This roller, however, is more expensive to manufacture and may increase curling of recording paper. Consequently, one solution encounters another problem, that is, curling of the recording paper may be increased.

SUMMARY OF THE INVENTION

It is an object of the present invention is to provide a toner image fixing device which may require reduced power consumption and warm-up time, and yet may be manufactured at relatively low cost and which is capable of freely changing its fixing power (condition) without causing recording paper to curl up.

It is another object of the present invention is to provide a toner image fixing device which has an increased curvature of a heating portion enough to eliminate the necessity of a separating finger and, at the same time, may eliminate the possibility of curling of recording paper.

It is another object of the present invention is to provide a toner image fixing device which may obtain an enough nip width and, at the same time, eliminate the possibility of occurrence of toner offset.

It is another object of the present invention to provide a toner image fixing device for fixing a toner image developed on a sheet of recording paper by heating, which comprises a rotatable cylinder body made of heat-resistant and heat-conducting material, which has a wall being elastically deformable in radial direction to obtain a nipping width necessary for fixing the toner image on the recording paper; a heater disposed in the cylinder body; and a paper guiding member movable in the direction of contacting with the cylinder body and being abutting thereon to elastically deform said cylinder body in radial direction to form a nip portion of a necessary width therebetween and to support a reverse side of the recording paper carrying the toner image developed on its top side.

PREFERRED EMBODIMENT OF THE INVENTION

Figure 1:
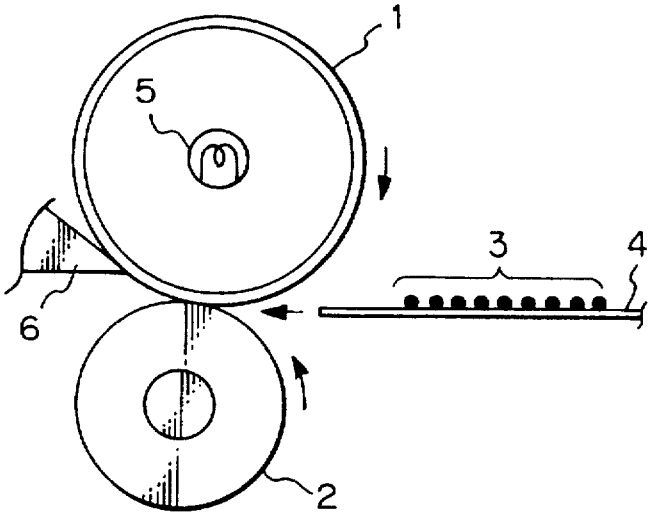
FIG.1 ( PRIOR ART )
FIG. 1 is a sectional view of an example of a conventional toner-image fixing device.

FIG. 1 illustrates an example of a conventional toner image fixing device, wherein a rotatably mounted heating roller 1 made of aluminum drum coated with fluorocarbon resin (e.g., PTFE: polytetrafluoroethylene sold under the trade name "Teflon") which is well-releasable from toner and a pressure roller 2 coated with silicone rubber are disposed as pressed against each other to form therebetween a contact portion (nip) utilizing elastic deformation of the pressure roller 2. While a sheet 4 carrying a toner image developed with toner 3 thereon passes through the nip, the toner image is heated and fixed by fusing onto the sheet 4. A heater 5 consisting of, e.g., a halogen lamp is mounted in the heating roller 1 to heat the latter at a specified temperature necessary for fusing toner of the toner image on the sheet.

In FIG. 1, numeral 6 designates a separating finger pressed at its head against the external cylindrical surface of the heating roller 1 to separate the sheet 4 from the heating roller.

In the above-mentioned fixing device, the heating roller is made of an aluminum pipe having wall thickness of 1.0 mm to several millimeters and outer diameter of 20 to 60 mm. A toner image developed with toner on the paper sheet 4 is fixed by fusing while the sheet passes through a nip (contacting portion) between the pressure roller 2 and the heating roller 1 heated at a specified temperature by the heater 5 axially mounted therein.

Figure 2:
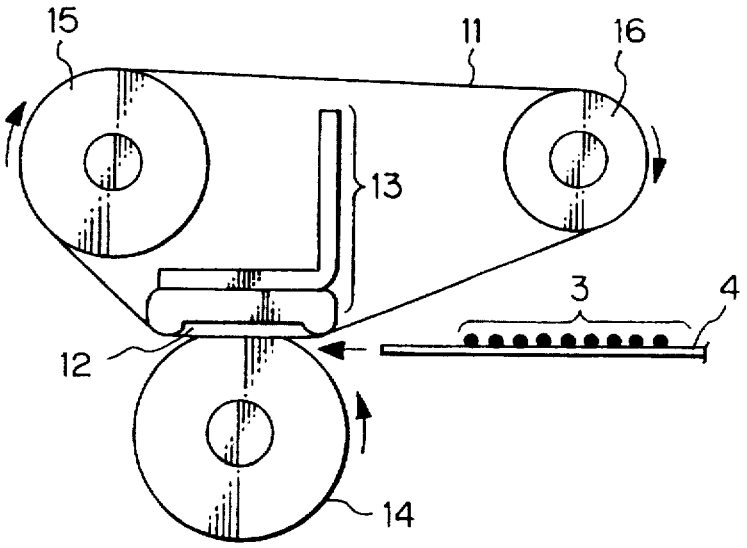
FIG.2 ( PRIOR ART )
FIG. 2 is a sectional view of another example of a conventional toner image fixing device.

Another example of a toner image fixing device that is different from the above-mentioned device is proposed in Japanese laying-open patent publications Nos. 59-68766 and 63-313182, which is shown in FIG. 2. A belt 11 being an endless film of 10 to 50 microns in thickness made of heat-resistant material (e.g., polyamide) envelops therein a heater supporting member 13 which supports a heater 12 having a resistance on a ceramic substrate in such a manner that the heater 12 may be in contact with an internal surface of the endless belt 11. A pressure roller 14 disposed in opposite to the heater 12 through the endless belt is pressed against an external surface of the endless belt 11 to form a nip portion through which a paper sheet having a developed toner image passes being subjected to fixture the toner thereon by fusing.

As described previously, the conventional toner image fixing device shown in FIG. 1 uses the heating roller 1 having a thick wall of 1.0 to several millimeters in radial direction, which, therefore, shall be previously heated by conduction heat to a specified working temperature of its surface for a warm-up time of several seconds to several minutes. The long warm-up time of the heating roller deteriorates the controllability of the device as well as increases the power consumption. To put a paper sheet 4 into contact with the heating roller 1, it is needed to use the pressure roller 2 having a metal core coated with silicone rubber, which is expensive in itself and increases a manufacturing cost of the conventional device.

In comparison with the above-mentioned device, the other conventional device shown in FIG. 2 uses a thin-film type belt 11 to be heated and, therefore, can save its warm-up time and reduce power consumption required. However, this device also has to use the pressure roller for putting the toner-image carrying paper sheet 4 into close contact with the rotating endless belt 11, that irrevocably leads to increasing the manufacturing cost of the device. The device must be provided with means for driving the endless belt 11, (e.g., a driving roller and a driven roller) , that may not only complicate the construction of the device but also increase its manufacturing cost.

Each of the conventional art devices uses a fixing member of roll-like form, which can not freely change a nip width and fixing power and, furthermore, may cause curling of recording paper along its body surface.

The necessary fixing power depends upon thickness of recording paper. The thicker recording paper is, the more it absorbs heat, i.e., the less heat is applied for fusing toner on the recording paper if heating temperature (for fixing) is constant. This may result in insufficient fusing the toner onto a thick paper sheet. Furthermore, some paper materials may not easily allow fixation of the toner image developed thereon. In such cases it is effective to selectively change, for instance, increase a nip portion (i.e., contacting surface) of a member for fixing by heat toner image on recording paper, that may increase fixing efficiency and improve the fixing condition of the toner image. For this purpose, pressing force of a pressing member to be applied to a heated member (e.g., a heating roller) is increased to form a wider nipping surface. However, increasing the pressing force to the heating roller may not sufficiently increase the nip width and may result in forcing the paper to be curled.

In the conventional devices, the contact surface of the roller, which comes into contact with a toner-image carrying paper sheet 4, is heated up to a temperature necessary for fusing toner and has a narrow limited nip width. Therefore, fixing is effected by heating the toner image to the boundary surface of the paper sheet 4. In this case, an upper part of the toner layer contacted to the heating roller may be heated to abnormally high temperature, reduce cohesive force and transfer to the heating roller surface (i.e., so-called high-temperature offset of toner occurs). On the contrary, when the fixing temperature is adjusted to a relatively low value, toner may keep well-cohesive power but be poor in adhesion to the paper sheet causing so-called low-temperature offset due-to insufficient fusion of the toner on the paper sheet.

In short, the paper sheet is heated at the same temperature during contacting with the heating roller since a whole cylindrical surface of the roller is evenly heated up to a specified temperature. Therefore, the toner may be overheated causing the high-temperature offset. On the contrary, the low-temperature toner offset may occur due to insufficient fusing if the roller surface temperature is adjusted to a relatively low temperature. For this reason, the conventional arts devices require high-accuracy temperature control as well as application of offset preventive liquid to the surface of the heating roller to be used.

Even temperature distribution over a whole nip (contact) portion may cause the above-mentioned toner offset. The nip width may be changed by changing pressing force of the pressure roller but this may intensify curling of the paper sheet. Namely, the recording paper 4 in heated state may be easily curled according to a curvature of the heating roller.

The curled paper may jam in the passage when it enters into the image-forming portion again for printing the other side (for two-side printing) or the same side (for double printing). To avoid this, it is necessary to provide a straightener at the downstream side of the fixing device.

In addition, the paper sheet after fixing the toner image thereon may also be in close contact with the heating roller and requires forcibly separation therefrom by a separating finger 6. To make the paper sheet depart by itself from the heating roller surface without using the separating finger 6, it is necessary to increase a curvature of the roller 1 to such an extent that the front end of the paper sheet may not follow up the roller. The roller 1 can have a larger curvature by reducing its diameter. In this case, the roller 1 shall have a diameter of not more than 20 mm. This is, of course, accompanied by increasing a degree of curling of the paper sheet. Furthermore, the heating roller 1 of not more than 20 mm in diameter may be hard and expensive to manufacture and may not posses sufficient durability.

As mentioned above, arrangement of a roller-like-formed member (i.e., a heating roller) in a heating portion may inevitably cause curling of recording paper. Namely, the heating roller usually has a constant nip and can not change fixing power by changing its nip width. Pressing force of the heating roller may be increased but can not attain a sufficient change of its nip width resulting in considerable curling of recording paper. Natural separation of recording paper from the heating roller may be realized by using a heating roller having an increased curvature and a reduced diameter. This roller, however, is more expensive to manufacture and may increase curling of recording paper. Consequently, one solution encounters another problem, that is, curling of the recording paper may be increased.

In a toner image fixing device according to the present invention, a sheet of recording paper carrying thereon a toner image to be fixed is guided by the paper guiding member to a contacting portion (nip) between the paper guiding member and the cylinder body. In this case, the rotating cylinder body is elastically deformable in radial direction at its portion currently contacting with the paper guiding member. Therefore, the cylinder body may transfer the recording sheet through the nip portion formed thereat, simultaneously giving heat to the sheet through its contacting surface heated by the heater. Toner of the toner image is fused by heat and fixed on the recording sheet. The cylinder body is made of heat-conductive material and has a thin wall enough to be elastically deformed. Therefore, it may have high heat-conductivity allowing itself to be heated by the heater to a specified surface temperature for a short time.

The device may use a low-cost flat-plate type paper guiding member, that may reduce the manufacturing cost of the device. Furthermore, using the elastically deformable cylinder body eliminates the necessity of using an expensive elastically deformable pressure roller which is used as the guiding member in the conventional device. In this case, recording paper may not be curled up because it is heated by the flat deformed cylinder body while being transported along a flat surface of the paper guiding member.

A nip can be set at any desired value by moving the paper guiding member toward the cylinder body. Namely, the cylinder body can be elastically deformed to sufficiently increase or decrease its contacting surface with a flat surface of the paper-guiding member. This enables the device to freely change its fixing condition by selecting a nip width suitable for recording paper.

A toner image fixing device according to the present invention has a reflector for effectively heating the cylinder body. Namely, this reflector plate may concentrically reflect radiation heat from the heater to the vicinity of an area wherein the rotating cylinder body enters into contact with the paper guiding member, thereby assuring effective heating of the recording paper carrying a toner-image when passing the nipping area between the cylinder body and the paper guiding member. Hence, temperature of the contacting surface of the cylinder body at the outlet side of the nipping area is decreased before the recording paper departs from the cylinder body and, therefore, the recording paper may depart from the cylinder body, carrying toner image having a sufficient cohesive force not to cause toner offset to the cylinder body surface. The cylinder body is rotated by the driving roller as it being in contact with the reflector plate internally and with the driving roller externally. A guide is also provided to regulate rotation of the cylinder body. This simplified arrangement is effective to stabilize the rotational motion of the cylinder body.

The cylinder body may easily get a curvature of no less than 1/20 mm at a point where the cylinder body departs from the paper guiding member by moving the latter toward the former. By virtue of these means, the recording paper may not be rolled up along the surface of the cylinder body but may naturally depart therefrom by the effect of its nerve.

Referring now to the accompanying drawings, preferred embodiments of the present invention will be described in detail.

Figure 3:
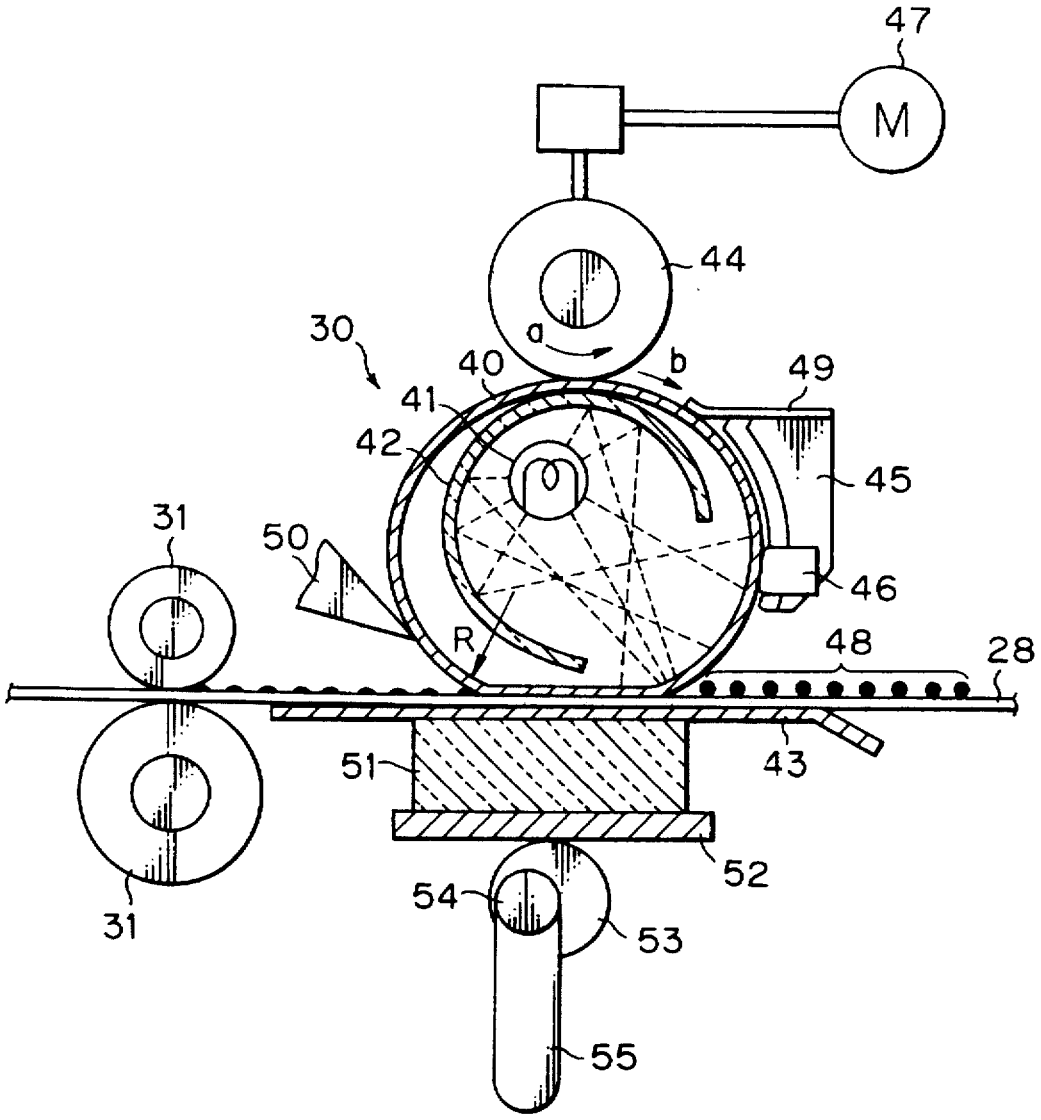
FIG. 3 is a sectional view of a toner-image fixing device embodying the present invention.
Figure 4:
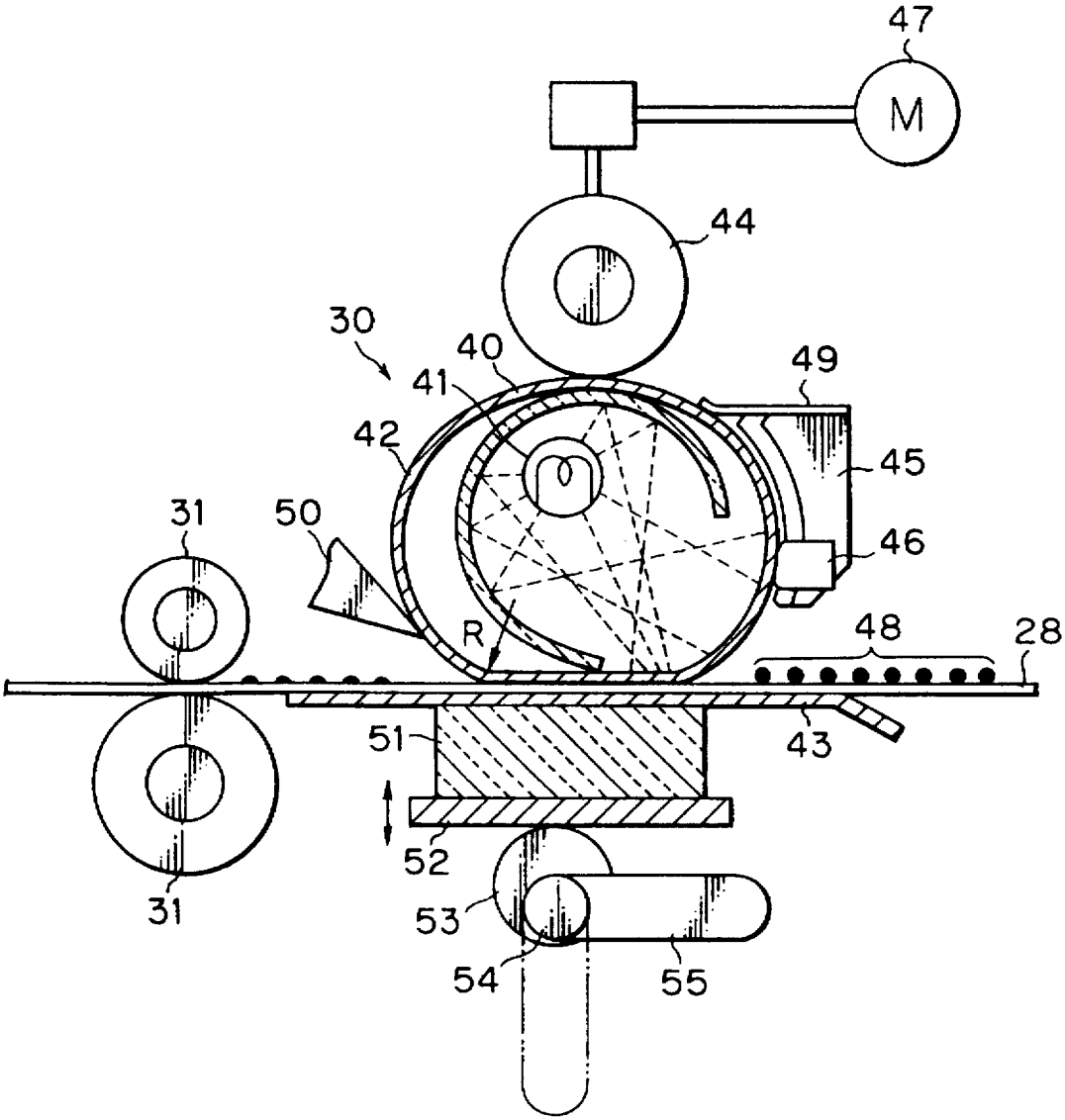
FIG. 4 is a sectional view showing a variable fixing condition of a toner-image fixing device embodying present invention.
Figure 5:
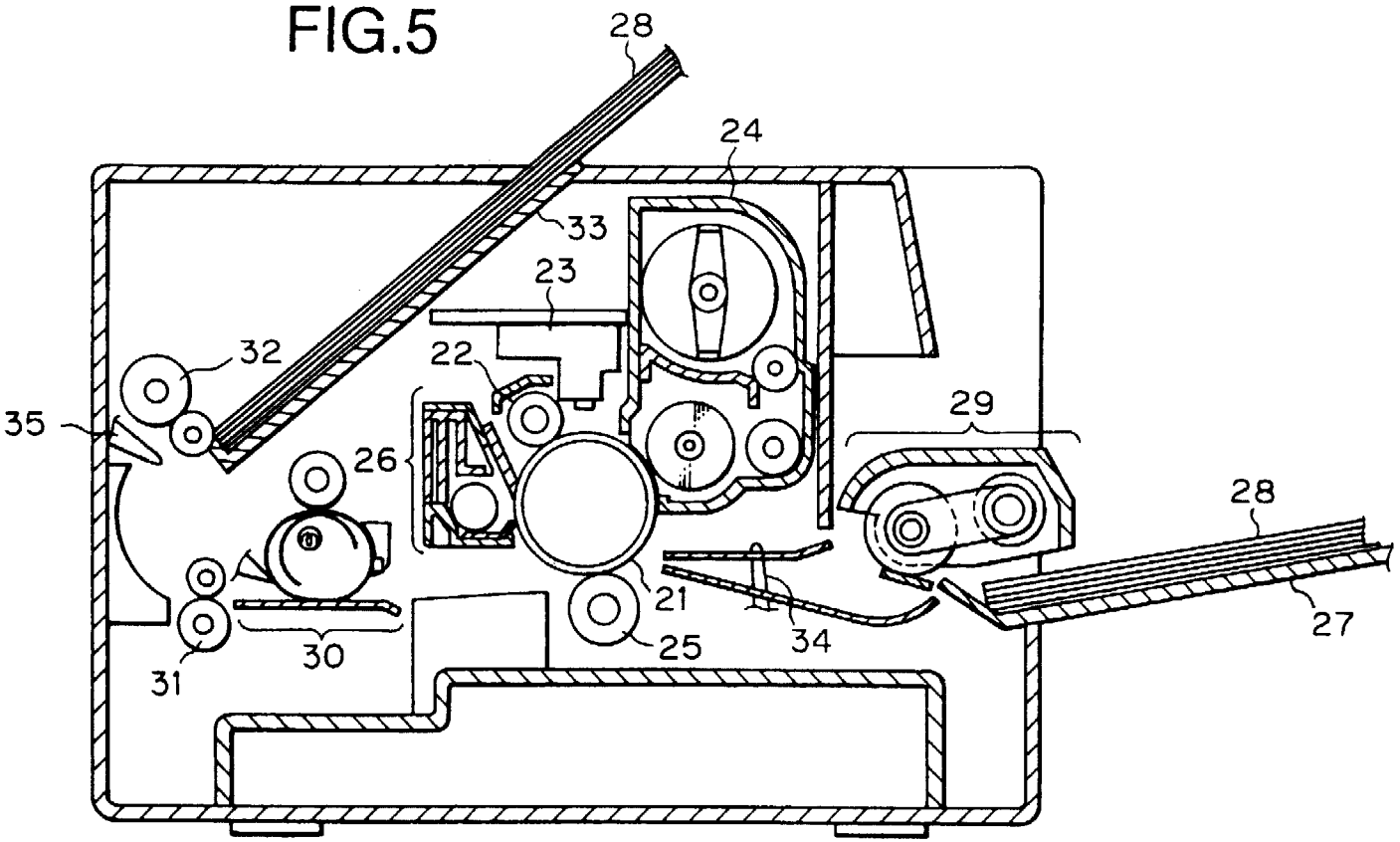
FIG. 5 is a diagrammatic sectional view showing a general construction of a light printer in which a toner-image fixing device according to the present invention is used.

FIG. 3 is a sectional view of a toner image fixing device embodying the present invention. FIG. 4 is a sectional view showing the changed fixing condition of a toner image fixing device according to the present invention. FIG. 5 is a diagrammatic sectional construction view of a light printer which represents an image forming device using a toner image fixing device according to the present invention.

Referring to FIG. 5, there is shown a light printer which includes a light-sensitive body 21 being a cylindrically formed recording medium, an electrically charging device (contact charging roller) 22 for laying-down a charge of specified polarity on the light-sensitive surface, a light-emitting portion 23 for driving a laser or a light-emitting diode according to an image forming information, a developing device 24 for applying toner for developing an electrostatic latent image formed by light irradiation on the light-sensitive medium, an image transferring device (transfer roller) 25 for transferring the toner image from the light-sensitive body to a sheet of recording paper and a cleaner 26 for removing remaining toner particles from the surface of the light-sensitive body prior to building up a following latent image.

A top sheet of common recording sheets 28 piled on a sheet-feeding tray 27 is fed by sheet feeding means to the image transfer roller 25 by which the sheet 28 is guided into a path between the surface of the rotating light-sensitive body 21 and the image transfer roller 25. An image developed with toner on the surface of the rotating light-sensitive body 21 is transferred by the image transfer roller 25 onto the sheet 28 when the latter passing the path therebetween.

The sheet 28 carrying the transferred thereon toner image is separated from the light-sensitive body 21 and fed to a toner image fixing device 30 for fusing toner of the image onto the sheet 28 by heat, whose construction is shown in detail in FIG. 3. The toner image is fixed on the sheet 28 while the latter passes through the fixing device 30. The sheet 28 is transported by delivery rollers 31 and 32 to a delivery tray 33.

In FIG. 5, numerals 34 and 35 designate sheet detectors (micro-switches) for detecting a sheet at the inlet and the outlet, respectively, of the printer. When detector 34 detects a recording paper sheet 28 at the inlet of printer, it operates to stop the operation of the sheet feeding means 29, stopping the sheet at the inlet. The detector 34 then operates to start again the feeding operation of the sheet feeding means 29 in synchronism with rotation of the light-sensitive body 21 so that the front edge of the sheet 28 may meet with the front edge of a specified toner-image forming area on the surface of the light-sensitive body 21. The sheet detector 35 detects the printed sheet 28 reached at the outlet of the printer and simultaneously generates a delivered sheet detection signal that is used for counting printed sheets by a sheet counter and for instructing the sheet feeding means 29 to start feeding a next sheet.

Referring now to FIG. 3, there is shown a toner image fixing device according to the present invention, which is composed of a cylinder-like-formed heat-resistant belt 40, a heater-lamp 41 disposed inside the space of the belt to be heated, a reflecting plate 42 for reflect radiant heat from the heater-lamp 41 and a paper guide plate 43 for leading a sheet 28 to be printed 48 to pass around the heat-resisting belt 40 toward a delivery rollers 31.

As shown in FIG. 3, the paper guide plate 43 with a heat insulating member 51 disposed thereunder is secured on the mounting plate 52, that minimizes discharge of heat from the heat-resistant belt 40 through the paper guide plate 43. This may increase the coefficient of effective use of heat, reducing warm-up time of the fixing device. It is preferable to use the heat insulating member 51 having heat conductivity of not more than 10 W/mK, which may be, e.g., silicone-rubber foam, fluorocarbon-rubber foam, polyurethane foam and chloroprene foam. The heat insulating member 51 may be arranged under the whole length of the paper guide plate 43. It is effective to dispose the heat insulating member 51 under the area of the paper guide plate 43, which is equal to or somewhat larger than the area of contact of the heat-resistant belt 40 with the recording paper sheet 28.

The paper guide plate 43 is movably mounted on a frame of the toner image fixing device 30 by means of the heat-insulating member 51 so that it may change a nip width of the heat-resistant belt 40 for selectively changing fixing condition. As shown in FIG. 3, a mechanism for moving the paper guide plate consists of the mounting plate 52 movably mounted on the frame of the toner-image fixing device 30 and a rotatable eccentric cam 53 which supports the mounting plate 52 with paper guide plate secured thereto together with the heat-insulating member. The eccentric cam 53 is fitted onto a rotation shaft 54 rotatably mounted on the body frame of the toner-image fixing device 30. The paper guide plate 43 can be vertically moved to contact with the heat-resistant belt 40 through vertical movement of the mounting plate 52 that is realized by turning an operating lever 55 attached to the rotation shaft 54 of the eccentric cam 53.

When the operating lever 55 is turned from a position shown in FIG. 3 to a position shown in FIG. 4, the long-radius side of the eccentric cam 53 is positioned on the mounting plate side, moving up the paper guide plate 43. At the same time, the heat-resistant belt 40 flatly deforms along the flat top-surface of the paper guide plate 43 to widen its nip portion. Fixing condition can be thus changed to obtain the improved quality of toner fixation. For instance, a toner image developed on thick recording paper 28 may be fixed with the same quality level as that on thin recording paper by selecting a wider suitable nip width.

The heat-resistant belt 40 is, for example, a flexible nickel-made belt which is produced by electro-casting method in the form of an elastically deformable endless belt of about 300 microns in thickness and of about 80 mm in circumferential length. Its diameter is about 25 mm. The heat-resistant nickel-made belt 40 also has an excellent heat-conductivity.

This cylinder-like-formed heat-resistant belt 40 accommodates therein the heater-lamp 41 for heating the belt, which may be, for example, a halogen lamp of 200 KW. The reflecting plate 42 is disposed between the heat-resistant belt 40 and the halogen lamp 41 to effectively heat the belt by concentrically reflecting radiant heat to the vicinity of an area wherein the belt 40 enters into contact with the recording paper sheet 28 guided by the paper guide plate 43.

The reflecting plate 42 may be, for example, an incurved aluminum plate of high reflecting power, which is disposed so that it may bring the radiant heat from the halogen lamp 41 to the vicinity of the paper inlet of the fixing area formed between the belt 40 and the paper guide plate 43. Namely, the reflecting plate 42 is intended to concentrate radiant heat from the halogen lamp 41 at the vicinity of the paper inlet of the fixing area and to shade radiant heat from the paper outlet side of the fixing area not to further heat the heat-resistant belt 40 before departing from the recording paper 28 on the paper guide plate 43. Consequently, the heat-resistant belt 40 may not be heated with radiant heat in the downstream side of the fixing area and, therefore, its temperature thereat is lower than that at the inlet side.

The heat-resistant belt 40 is driven into rotation by the driving roller 44 pressed against belt 40 which is sandwiched between the driving roller 44 and the outwardly curved rear-surface of the reflecting plate 42. The belt guide 45 having a guiding surface incurved in accordance with the surface of the cylindrical surface of the belt 40 to stabilize the rotational movement of the belt 40 by preventing its lateral shift. Arrangement of the belt guide 45 on the downstream side of the heat-resistant belt 40 in its rotation, i.e., after being driven by the driving roller 44, is especially effective to bring the belt 40 into contact with the recording paper 28 in the stabilized condition, that may assure reliable fixing process.

This belt guide 45 has a temperature sensor 46 secured thereto for detecting surface temperature of the belt 40. The surface temperature of the heat-resistant belt 40 can be maintained at a constant specified value by regulating power supply (not shown) of the halogen lamp 41 according to a temperature detection signal generated from the temperature sensor 46. For this purpose, the temperature sensor 46 is preferably disposed close to an area wherein the heat-resistant belt 40 contacts with the recording paper 28. Namely, the heat-resistant belt 40 after being heated to a temperature necessary for fusing toner may enter into contact with the recording paper 28 to effectively fix by heat a toner image developed thereon.

The driving roller 44 is driven by driving motor 47 through transmission means, e.g., gear transmission and drives the heat-resistant belt 40. The driving roller 44 may be, for example, a heat-resistant silicone-rubber roller which is rotatably supported, pressing the belt 40 against the rear surface (opposite to the reflecting surface) of the reflecting plate 42.

Accordingly, to drive the heat-resistant belt 40 in rotation by the driving roller 44, it is needed to get a friction resistance of the rear surface of the reflecting plate 42 against the heat-resistant belt 40 smaller than that of the driving roller against the heat-resistant belt 40. In this condition, the heat-resistant belt 40 can be rotated slipping on the rear surface of the reflecting plate 42 as the driving roller 44 rotates. The reflecting plate 42 having a small friction contact with the heat-resistant belt 40 is selected. Coating the rear surface of the reflecting plate 42 with fluorocarbon resin is effective to reduce the friction force.

The operation of the above-mentioned toner-image fixing device 30 will be explained as follows.

A recording-paper sheet 28 whereon a toner image 48 was developed in the preceding process in the printer is separated from the rotating light-sensitive body 21 and advanced by the rotational movement of the light-sensitive body 21 and the transfer roller 25 along the paper guide plate 43 to the portion contacting with the heat-resistant belt 40 of the toner-image fixing device. The driving roller 44 is driven from the driving motor 47 and drives by frictional contact the heat-resistant belt 40 into rotation in the direction shown by arrow b in FIG. 4. In this case, the heat-resistant belt 40 is forced to move right wards but is restricted the belt guide 45 allowing the belt to rotate keeping its constant position.

The sheet 28 moves along the paper guide 43 and enters into contact with the heat-resistant belt 40, then it is advanced along the paper guide 43 under the pressure of the heat-resistant belt being deformed in its radial direction. At the same time, as the heat-resistant belt is heated at a specified temperature by a combination of the heater-lamp 41 and the reflecting plate 42 according to a temperature detection signal of the temperature sensor 46, the toner image is fused by heat and fixed on the sheet 28. The sheet 28 is further sent along the paper guide 43 by rotation of the heat-resistant belt 40, then it departs from the heat-resistant belt 40 and delivered by the transporting rollers 31.

The heat-resistant belt 40 which, as described above, is made of heat-conducting material and heated directly by the heater-lamp 41. Therefore, it may be instantaneously heated and kept at the specified temperature. Namely, this heat-resistant belt 40 is different from the conventional rotatably driven roller by that it can be made in the form of a thin film and heated up to a specified temperature as soon as the heater-lamp 41 is turned ON. This makes it possible to sufficiently heat the heat-resistant belt 40 without increasing the heat capacity of the heater-lamp 41, resulting in saving the power consumption of the device. Furthermore, provision of the reflecting plate 42 together with the heater-lamp 41 inside the heat-resistant belt 40 realizes concentrically heating such a surface area of the rotating heat-resistant belt 40 that enters into contact with the sheet 28 carrying thereon a toner image to be fixed. In other words, the heat-resistant belt 40, unlike the conventional roller requiring heating its whole body, may be heated only a portion of the rotating belt currently necessary for fixing the toner image on the sheet. This realizes effective use of heat, making it possible to shorten the warm-up time and save the power consumption of the device.

The heat-resistant belt 40 is driven by frictional contact of the driving roller 44, that eliminates the necessity of using expensive transmission gears and bearings which are used for the conventional heating roller. Furthermore, provision of the belt guide 45 and reflecting plate 42 assures stabilized rotation of the heat-resistant belt 40, thereby the driving system can be simplified and the manufacturing cost of the device may be correspondingly reduced.

The sheet 28 can be pressed against the heat-resistant belt 40 by using the paper guide plate 43 only, that eliminates the necessity of using conventional pressing means and an expensive elastically deformable silicone-rubber roller. The manufacturing cost of the device may be considerably reduced in comparison with the conventional device.

The toner-image fixing device 30 shown in FIG. 3 uses a flat type paper-guide plate 43 which is required to guide a sheet 28 to a contacting portion of the heat-resistant belt 40, while the conventional method requires using an expensive silicone-rubber roller which must be elastically deformable.

The paper guide plate 43 is movable in the direction of contacting with the heat-resistant belt 40. Therefore, fixing condition (contacting with the belt 40) can be changed in accordance with thickness and material of recording paper 28. For instance, in the case of using recording paper 28 of normal thickness, the operating lever 55 is shifted to the position shown in FIG. 3 to set a small nip value before beginning the image forming process in the printer. On the contrary, in the case of printing thick recording paper, the operating lever 55 is turned to the position shown in FIG. 4 to select a large nip value. By doing so, a distance of contacting the heat-resistant belt 40 with a toner-image-formed portion of the recording paper is increased, improving the fixing condition to the same level as that of thin recording paper.

The movable paper guide plate 43 can easily be set and held at a position where the heat-resistant belt 40 has a curvature of no less than 1/20 mm. This position is shown in FIG. 3 and used for fixing a toner image on a normally thick recording sheet 28. For recording paper 28 having larger thickness than the normal, the paper guide plate 43 is further moved toward the heat-resistant belt 40 to increase a nip width by placing the operating lever 55 at the position shown in FIG. 4. By doing so, it is assured for the thicker recording paper to get the same level of fixation of toner image thereon as that for normally thick paper. Namely, the fixing condition can be changed by shifting the operation lever 55 to the position shown in FIG. 3 or FIG. 4 in accordance with thickness of usable recording paper 28.

With any selected nip width, the recording paper sheet 28 is transferred along the flat surface of the paper guide plate 43, being pressed by the flattened surface of the heat-resistant belt 40 and, thereby, not being curled up in the fixing device. This means that the nip width, i.e., fixing condition of the fixing device can be freely changed with no fear of occurrence of curling of the recording paper.

The above-mentioned embodiment uses two-way switching system of an operating lever 55 for selecting a nip width. On the other hand, it is also possible to use such a mechanical drive that transmits rotational motion of a driving motor to a rotation shaft of an eccentric cam 53 secured thereon and, thereby, turns the eccentric cam 53 to any position corresponding to a desired nip to be formed by the heat-resistant belt 40. Accordingly, any desired nip width can be automatically selected instead of manual selection with the lever 55 according to thickness of a recording paper sheet, which may be detected or manually inputted in advance. Fixing condition (nip width) can be set in accordance with material of recording paper besides its thickness. For instance, in the case of using recording paper whereto toner image is relatively hard to be fixed, it is necessary to change nip width to a suitable value. This selection is easily made by the above-mentioned mechanism.

In FIG. 3, numeral 50 designates a separating finger contacting at its tip with the outer surface of the heat-resistant belt 40 to separate the leading edge of the recording paper sheet 28 from the belt 40. The necessity of the separating finger, however, may be eliminated when a curvature of the heat-resistant belt 40 in an area shown by arrow R in FIG. 3 is not smaller than 1/20 mm whereat the leading edge of the recording paper can not follow up the upward curving portion of the heat-resistant belt 40 and naturally departs therefrom by virtue of its nerve. The heat-resistant belt 40 used in the above-mentioned embodiment has a circumferential length of 80 mm and diameter of about 25 mm. Therefore, the heat-resistant belt 40 as be in cylindrical form has a curvature of 1/25 mm which is smaller than 1/20 mm.

The heat-resistant belt 40 is of 25 mm in diameter but deformable in radial direction when its branch is pressed against a recording paper guided by the vertically movable paper guide plate 43. The curvature of the heat-resistant belt 40 gradually increases as the paper guide plate 43 moves up toward the belt 40. Therefore, the belt 40 can easily get a curvature of not smaller than 1/20 mm by adjusting the paper guide plate in vertical direction of flattening the cylindrical heat-resistant belt 40. The device involves no factor for causing the recording paper to curl. Therefore, the belt curvature can be increased enough to realize natural departure of the recording paper 28 from the belt 40 with no fear of curling of the latter. The curvature of the heat-resistant belt 40 can be increased by lifting the paper guide plate 43 toward the belt 40.

On the other hand, in case of the fixing device 30 of FIG. 3, the sheet must be transported along the paper guide plate 43 by frictional drive of the rotating heat-resistant belt 40, therefore it is important to reduce the friction coefficient of the paper guide plate 43 relative to the sheet 28. For this purpose, it is effective to apply a coat of fluorocarbon resin (PTFE: Polytetrafluoroethylene) to the surface of the paper guide plate 43 to be in contact with a sheet 28.

The PTFE coat on the paper-guide plate is well-releasable from the toner image. Therefore, it may be free from toner adhesion thereto and may not soil the reverse side of the sheet 28 with toner. The PTFE coat of the paper-guide plate 43 lightens adhesion of the sheet 28 thereto and makes the frictional resistance of the paper guide plate 43 relative to the sheet 28 smaller than that of the heat-resistant belt 40 relative to the sheet 28, that enables the sheet 28 to smoothly move along the paper guide plate 43 by the frictional drive of the heat-resistant belt 40 without slipping on the sheet 28. In short, the heat-resistant belt 40 can stably transport the sheet 28 and reliably fix the toner image on the sheet 28 with no disturbance of the image.

Since the heat-resistant belt 40 contacts the toner image on the sheet 28, its contact surface is desired to have enough ability to part from toner particles. Namely, it is essential to prevent toner from adhering first to the heat-resistant belt and then transferring to a next sheet (toner offset). For this purpose, the heat-resistant belt is covered with a coat of fluorocarbon resin. In case the paper guide plate 43 is also coated with fluorocarbon resin, the heat-resistant belt 40 and the paper guide plate 43 have the same frictional resistance against the sheet 28, that may cause the belt 40 to rub and break the toner image on the sheet 28.

In this case, it is effective to make toughened the fluorocarbon-resin coated surface of the heat-resistant belt 40 to increase its friction coefficient more than that of the paper guide plate 43. The toner image surface of the sheet 28 to be heated is toughened to prevent the above-mentioned trouble from occurring. The coated surface of the paper guide plate 43 is preferred to have been smoothly finished. It is also possible to cover the surface of the heat-resistant belt 40 with a coat of silicone rubber being free from toner adhesion thereto and having such a friction coefficient relative to the sheet 28 that is sufficiently higher than that of the paper guide plate 43. By doing so, the possibility of breaking the toner image is eliminated and the transportability of the sheet is also improved. With the toner-image fixing device according to the present invention, the recording paper 28 carrying toner image developed thereon enters into contact with the heat-resistant belt 40 and heated sufficiently to fuse the toner and to get a boundary temperature enough to fix the toner particles thereon. Then, the heat-resistant belt 40 transports the recording paper keeping cohesion of toner at a constant level on the recording paper along the paper guide plate toward the delivery portion. The belt 40 has a decreased surface temperature in the downstream-side contacting area. This is realized by increasing a nip width of the belt. Therefore, toner on the recording paper in the downstream-side contacting area can have a cohesive power lager than adhesion to the belt 40, thereby preventing toner from transferring to the belt surface. Namely, toner on the recording paper can be sufficiently fused by heat just after entering into contact with the heat-resistant belt 40 without causing toner offset due to insufficient heating, while toner on the recording paper in downstream-side contacting area may have cohesion larger than adhesion to the belt 40 having a decreased surface temperature, thereby preventing the toner from offsetting to the belt. This eliminates the necessity of applying offset preventive liquid to the contacting surface of the belt 40.

As mentioned before, the heat-resistant belt 40 has no factor of curling recording paper and, therefore, it can be deformed enough to obtain a large nip width at which toner offset can not occur.

If there is still a fear of occurrence of toner offset in such a way that toner from a currently processed sheet 28 adheres to the coated surface of the heat-resistant belt 40 and is then transferred to a next sheet 28 to be processed, it is optimal to clean the surface of the heat-resistant belt 40 before the belt 40 comes into contact with the next sheet. Cleaning can be conducted, for example, by a cleaning blade 49 which is secured at one end to the belt guide 45 and presses at the other free end against the external surface of the heat-resistant belt 40 to scrape off toner particles adhering to the belt surface. The blade 49 may be made of, e.g., stainless steel sheet SUS304 of 0.2 mm in thickness.

Figure 6:
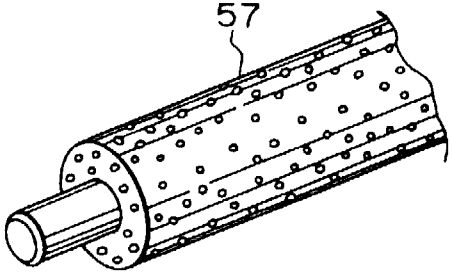
FIG. 6 is a perspective view of a cleaning roller composing a part of a toner-image fixing device embodying the present invention.

It is also effective to provide a cleaning roller in place of the cleaning blade 49. FIG. 6 shows an example of a cleaning roller 57 which is made of silicone rubber and may be driven either from a driving motor (not shown) through transmission means or by frictional contact with the heat-resistant belt 40.

The above-mentioned cleaning roller 57 may be made of silicone-rubber foam impregnated with silicone oil that may exude little by little by the effect of heat and pressure from the heat-resistant belt 40 and lubricates the surface of the heat-resistant belt when the roller is cleaning the belt. Lubrication with silicone oil improves the ability of the belt 40 to part from the toner and, thereby, effectively prevents contamination of the belt surface with toner particles.

The above-mentioned silicone-rubber roller 57 for cleaning the heat-resistant belt 40 can be also used as the driving roller 44. In short, the silicone-rubber roller of FIG. 6 is used in place of the driving roller 44 of FIG. 3.

As described above, the toner fixing device (FIG. 3) according to the present invention may be composed of, at least, a rotatable heat-resistant belt 40 made in the form of a cylinder body, a heater-lamp 41 and a paper guide plate 43 for guiding a sheet 28 to pass through a nip portion formed between the heat-resistant belt 40 and the paper guide plate 43, characterized in that the paper guide plate 43 has a flat guiding surface and can be moved toward the heat-resistant belt 40. When the sheet is nipped, the cylindrically formed heat-resistant belt 40 is elastically deformed by the paper guide plate 43 and presses the toner image carrying sheet 28 by its force to restore into the original form, and, at the same time, heats the toner image thereon by its surface heated by the heater-lamp 41. The toner is fused and toner image is fixed on the sheet 28. It is also possible to obtain any desired nip width by deforming the belt 40 by lifting the paper guide plate. In this case, the heat-resistant belt 40 can deforms its contacting surface to be flat according to the flat surface of the paper guide plate 43, that eliminates the possibility of curling the recording paper to be nipped and heated.

In the toner image fixing device, it required about 5 seconds to heat the heat-resistant belt 40 from an ambient temperature 25° C. to a specified surface temperature of 180° C. necessary for fixing the toner image on the sheet. The experiment was conducted in such conditions (material and thickness of the belt 40 and temperature of the heat-resistant belt 40 and heat capacity of the heater lamp 41), which are defined for the preferred embodiment of the present invention. The fixing device according to the present invention in comparison with the conventional device of FIG. 1 proved considerable reduction of the warm-up time. Consequently, the required power consumption of the device was reduced by 40% as compared with that of the conventional device.

As is apparent from the foregoing, the toner fixing device according to the present invention offers the following advantages.

Since a heating and fixing portion which comes into contact with a toner image on a sheet of recording paper is not a roller but an elastically deformable cylinder body having a very thin wall, it is possible to shorten the warm-up time necessary to heat the cylinder wall by a heater to a specified temperature. Using the cylindrical body made of metal having a high heat conductivity may further reduce the warm-up time of the device.

The cylinder body is driven by frictional contact with a driving roller and is elastically deformable by using a flat member. This may considerably reduce the manufacturing cost of the device and, at the same time, eliminate the possibility of curling recording paper.

The cylinder body is directly and concentrically heated at its portion currently necessary for fixing the toner image on the sheet, that may increase heat efficiency and reduce power consumption of the device. The paper guide plate can be moved up for making the cylinder body be elastically deformed so that the cylindrical body may have a curvature necessary for making the front edge of the recording paper naturally depart from the cylindrical body and/or it may form any desired nip for assuring necessary fixing condition and temperature distribution. All these settings can be freely made with no fear of curling recording paper to be nipped and heated by the cylinder body.

I claim:

1. A toner image fixing device for fixing a toner image formed on a sheet of recording paper by heating, comprising:

a rotatable cylinder body made of heat-resistant heat-conducting material, which has a wall being elastically deformable in radial direction to form a nip having a width necessary for fixing the toner image on the recording paper;

a heater disposed in the cylinder body; and a paper-guiding flat member abutting on an external surface of the cylinder body to elastically deform said cylinder body in radial direction to form a necessary nip therebetween and to support a reverse side of the recording paper carrying the toner image developed on its top side, characterized in that the paper guiding member is disposed movably in the direction of contacting with the cylindrical body.

2. A toner image fixing device for fixing a toner image formed on a sheet of recording paper by heating, comprising:

a rotatable cylinder body made of heat-resistant heat-conducting material, which has a wall being elastically deformable in radial direction to form a nip having a width necessary for fixing the toner image on the recording paper;

a heater disposed in the cylinder body;

a reflecting plate abutting on an inner surface of the cylinder body to reflect radiation heat from the heater;

a paper-guiding flat member mounted movably in the direction of abutting on the cylinder body and abutting thereon to elastically deform said cylinder body in radial direction to form a necessary nip therebetween and to support a reverse side of the recording paper carrying the toner image developed on a top side of the recording paper;

a driving roller for rotating the cylinder body in the state of the cylinder body being sandwiched between the driving roller and the reflector plate;

a cylinder guiding member disposed between the driving roller and the paper guiding member around the cylinder body to regulate rotation of the cylinder body;

a shifting mechanism for moving the paper-guiding flat member in the direction of contacting said guiding member with the cylinder body optionally change the nip width.

3. A toner image fixing device as defined in any one of claims 1 and 2, characterized in that the cylinder body at a departing position on the downstream side of a passage for transferring recording paper between the cylinder body and the paper-guiding flat member has a curvature not less than $1/20$ mm.

4. A toner image fixing device as defined in any one of claims 1 and 2, characterized in that the heater or the reflector plate is disposed in such a way that a radiation heat from the heater is concentrated at an area wherein the cylinder body comes into contact with the paper-guiding flat member and the radiation heat from the heater is reduced in an area therefrom to a departing point of the cylinder body from the guiding member.

* * * * *